US007481615B2

(12) United States Patent
Park

(10) Patent No.: US 7,481,615 B2
(45) Date of Patent: Jan. 27, 2009

(54) FAN AND SHROUD ASSEMBLY

(75) Inventor: Se-Young Park, Daedeok-gu (KR)

(73) Assignee: Halla Climate Control Corp., Daejeon-si (KR)

( * ) Notice: Subject to any disclaimer, the term of this patent is extended or adjusted under 35 U.S.C. 154(b) by 296 days.

(21) Appl. No.: 11/277,548

(22) Filed: Mar. 27, 2006

(65) Prior Publication Data

US 2006/0216147 A1 Sep. 28, 2006

(30) Foreign Application Priority Data

Mar. 26, 2005 (KR) ..... 10-2005-0025221

(51) Int. Cl.
*F04D 29/08* (2006.01)

(52) U.S. Cl. ..... 415/173.5; 415/119; 415/173.6; 415/208.5; 415/220; 415/223; 416/189; 123/41.49

(58) Field of Classification Search ..... 415/173.1, 415/173.4, 173.5, 173.6, 220, 222, 223, 208.1, 415/211.1, 211.2, 186, 208.5, 173.3, 119; 416/189, 192, 169 A; 123/41.49; 277/411, 277/412, 414
See application file for complete search history.

(56) References Cited

U.S. PATENT DOCUMENTS 3,680,977 A * 8/1972 Rabouyt et al. ..... 415/173.6
4,311,431 A * 1/1982 Barbeau ..... 415/173.6
5,489,186 A * 2/1996 Yapp et al. ..... 415/58.7
6,254,343 B1 * 7/2001 Schmidt et al. ..... 415/222
6,579,063 B2 * 6/2003 Stairs et al. ..... 416/169 A
6,863,496 B2 * 3/2005 Cho et al. ..... 415/173.5
6,874,990 B2 * 4/2005 Nadeau ..... 415/173.5
7,320,574 B2 * 1/2008 Greim et al. ..... 415/173.5
2003/0161728 A1 8/2003 Cho
2004/0156712 A1 * 8/2004 Nadeau ..... 415/174.5
2005/0100439 A1 * 5/2005 Greim et al. ..... 415/173.5

FOREIGN PATENT DOCUMENTS

EP 1443215 A2 * 8/2004
EP 1515000 A1 * 3/2005

* cited by examiner

*Primary Examiner*—Christopher Verdier
(74) *Attorney, Agent, or Firm*—Lowe Hauptman Ham & Berner LLP

(57) ABSTRACT

A fan and shroud assembly has a rotatable hub and plural blades extending outward from the hub. A shroud surrounding the fan controls air blast resulting from rotation of the fan. The shroud includes a guide ring spaced a predetermined distance from the periphery of the fan. The ends of the blades are connected together. The guide ring includes continuous circular undulations having alternate differing radii of curvature to reduce air swirl along the periphery of the fan. The undulations surround the fan periphery.

4 Claims, 11 Drawing Sheets

FAN AND SHROUD ASSEMBLY

RELATED APPLICATION

The present application is based on, and claims priority from, Korean Application Number 10-2005-0025221, filed Mar. 26, 2005, the disclosure of which is hereby incorporated by reference herein in its entirety.

BACKGROUND OF THE INVENTION

1. Field of the Invention

The present invention relates to a fan and shroud assembly used for an air blast in an air conditioner of a car, and more particularly, to a fan and shroud assembly which can effectively reduce noise by controlling generation of swirling airflow and backflow during the air blast by rotation of a fan.

2. Background Art

In general, an air conditioner for a car comprises a radiator, and an axial fan for cooling heat exchange medium flowing through a heat exchanger such as a condenser. As shown in FIG. 1, the axial fan 200 generally comprises a hub 230 connected with a shaft of a driving source such as a motor, and a plurality of blades 210 radially arranged on the outer periphery of the hub 230. The axial fan 200 may further include a fan band 220 connecting ends of the blades 210 to prevent transformation of the blades 210. Therefore, air can be axially blown by the blades 210 while the axial fan 200 is rotated by rotational force transmitted from the driving source to the hub 230. A shroud is fixed to the heat exchanger in order to effectively guide the blown air toward the heat exchanger. The shroud has a blast inlet as large as the axial fan can be rotatably inserted thereinto to guide the air blast in such a way as to support the motor.

As shown in FIGS. 2, 3 and 4, the shroud 100 of a puller type fan shroud assembly mounted on the rear of the heat exchanger to inhale air from the front of the heat exchanger and send air to the rear of the heat exchanger comprises: a housing 110 having a blast inlet 120 in which an axial fan 200 is rotatably inserted; a motor supporting ring 130 for supporting a motor (not shown) rotating the axial fan 200 at the center of the blast inlet 120 of the housing 110; and a plurality of guide vanes 140 for radially connecting the motor supporting ring 130 and the housing 110 with each other to support the motor supporting ring 130 and guide air discharged when the axial fan 200 is rotated.

The housing 110 is depressed to the rear to effectively guide sucked air toward the air blowing hole 120, and comprises connection ribs formed on the edges for coupling between the housing 110 and the heat exchanger.

The blast inlet 120 is formed by a guide ring 150 protruding backwardly from the housing 110 and curved from the rear end of the guide ring 150 toward the inside of the guide ring 150, and further comprises a bell mouth 180 for smoothly guiding a discharge of air.

Here, a plurality of swirl preventing saw teeth 160 are formed along the inner periphery of the blast inlet 120, that is, inner periphery of the guide ring 150. In the case where the bell mouth 180 is provided, the swirl preventing saw teeth 160 are formed integrally on the inner periphery of the guide ring 150 which is connected with the bell mouth 180.

The swirl preventing saw teeth 160 are spaced apart at a predetermined interval from the ends of the blades 210 of the axial fan 200. The swirl preventing saw teeth 160 comprise a first side 162 toward the rotational direction of the axial fan and a second side 164 toward the counter-rotational direction of the axial fan.

Such shroud having the swirl preventing saw teeth can reduce noise, but noise generated from the fan and shroud assembly is more increased when noise generated from the car is added. To solve the above problem, a configuration to which a bended bell mouth is provided to smoothly discharge air into the guide ring has been proposed. However, such configuration has a problem in that it is insufficient in reducing noise since it needs additional structure.

SUMMARY OF THE INVENTION

Accordingly, the present invention has been made to solve the above problems occurring in the prior art, and it is an object of the present invention to provide a fan and shroud assembly, which can increase a noise reduction effect by installing swirl preventing means on a guide ring part of a shroud keeping a predetermined interval from the periphery of a fan connecting ends of blades.

To accomplish the above objects, according to the present invention, there is provided a fan and shroud assembly comprising: a fan having a hub rotatable on a shaft and a plurality of blades extending outward from the hub; and a shroud surrounding the fan for controlling air blast resulting from rotation of the fan, wherein the shroud comprises: (a) a guide ring part spaced apart at a predetermined interval from the periphery of the fan, wherein the ends of the blades are connected together at the periphery of the fan; and (b) a swirl preventer including round-corrugation structure formed on the guide ring part for preventing swirling airflow along the periphery of the fan where the ends of the blades are connected.

Furthermore, the swirl preventer comprises round furrows having a predetermined radius of curvature at a portion which is depressed in a radial direction and round projections having a predetermined radius of curvature at a portion extending toward the center of the shroud, the round furrows and the round projections being repeatedly arranged and having differing radii of curvature.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings. Terms and words used in this specification and claims are to be interpreted with a meaning and in accordance with the concepts corresponding to the technical idea of the present invention, based on the principle that the inventor can properly define the concept of words to explain the inventor's invention in the best way.

Figure 1:
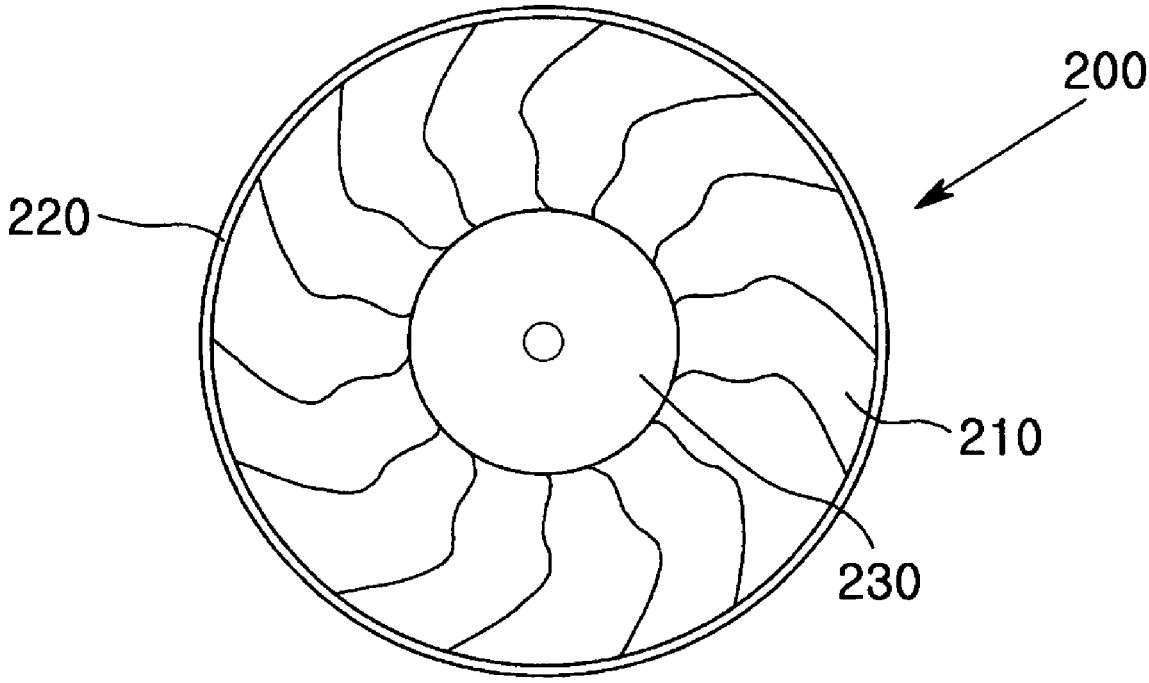
Fig. 1 PRIOR ART
FIG. 1 is a front view of the prior art axial fan, as previously discussed.
Figure 2:
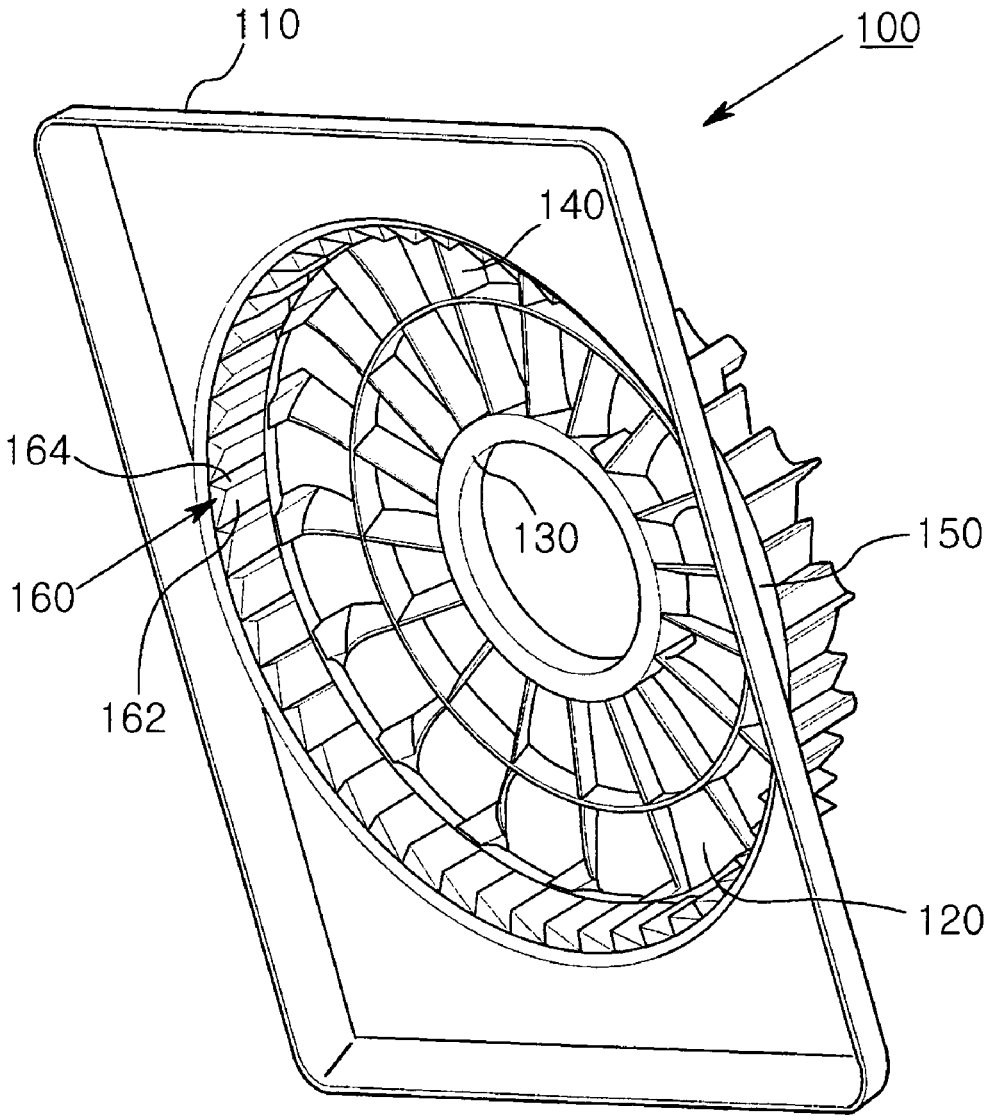
Fig. 2 PRIOR ART
FIG. 2 is a perspective view of the rear of the prior art shroud of the fan of FIG. 1.
Figure 3:
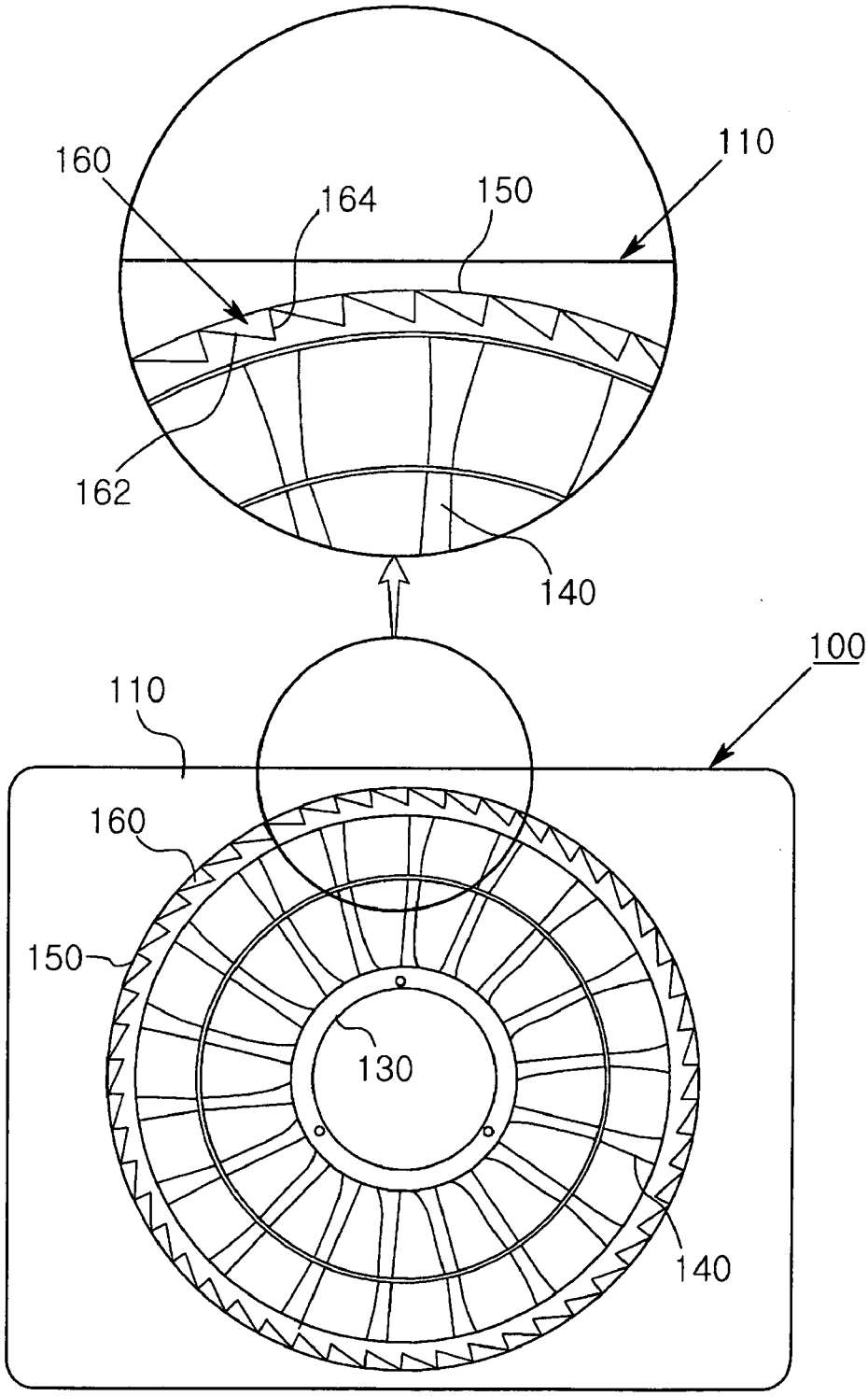
Fig. 3 PRIOR ART
FIG. 3 is a front view and a partially enlarged view of the prior art shroud of FIG. 2.
Figure 4:
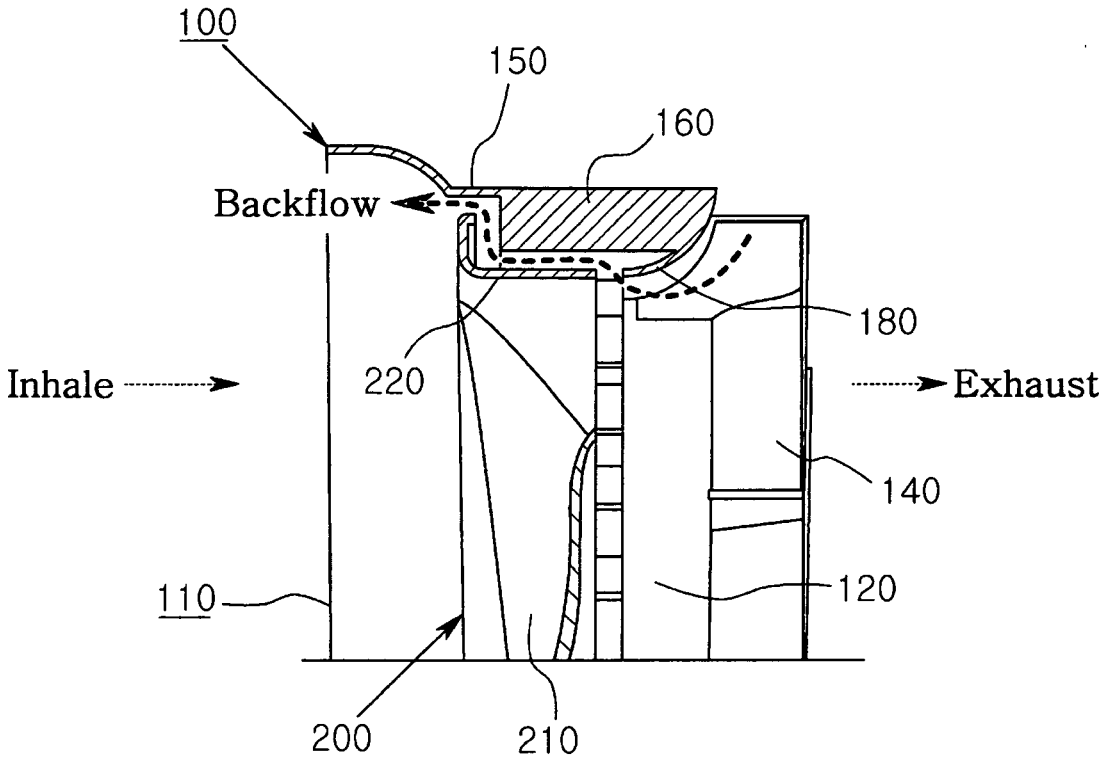
Fig. 4 PRIOR ART
FIG. 4 is a partially side sectional view of the prior art fan and shroud assembly of FIG. 1.
Figure 5:
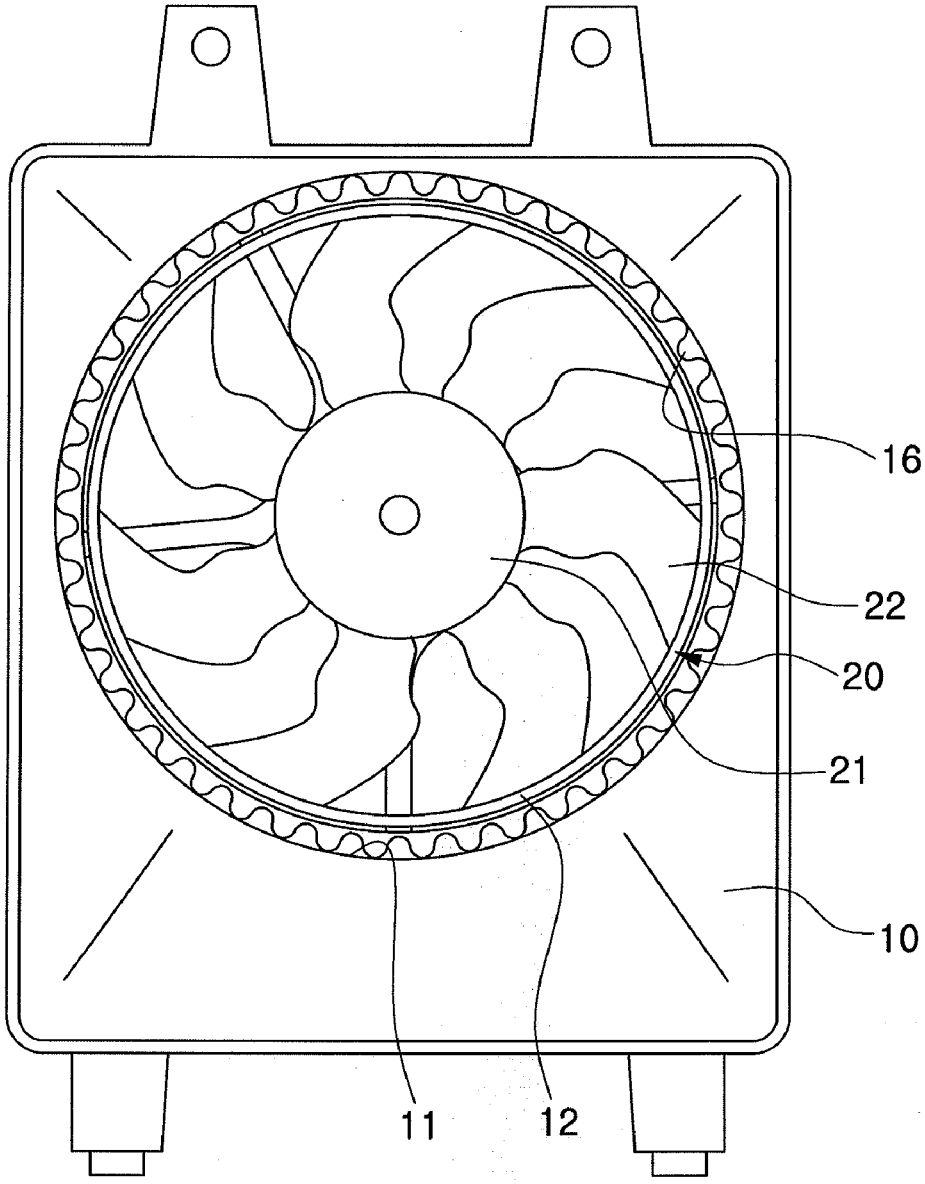
FIG. 5 is a front view of a fan and shroud assembly according to a preferred embodiment of the present invention.
Figure 6:
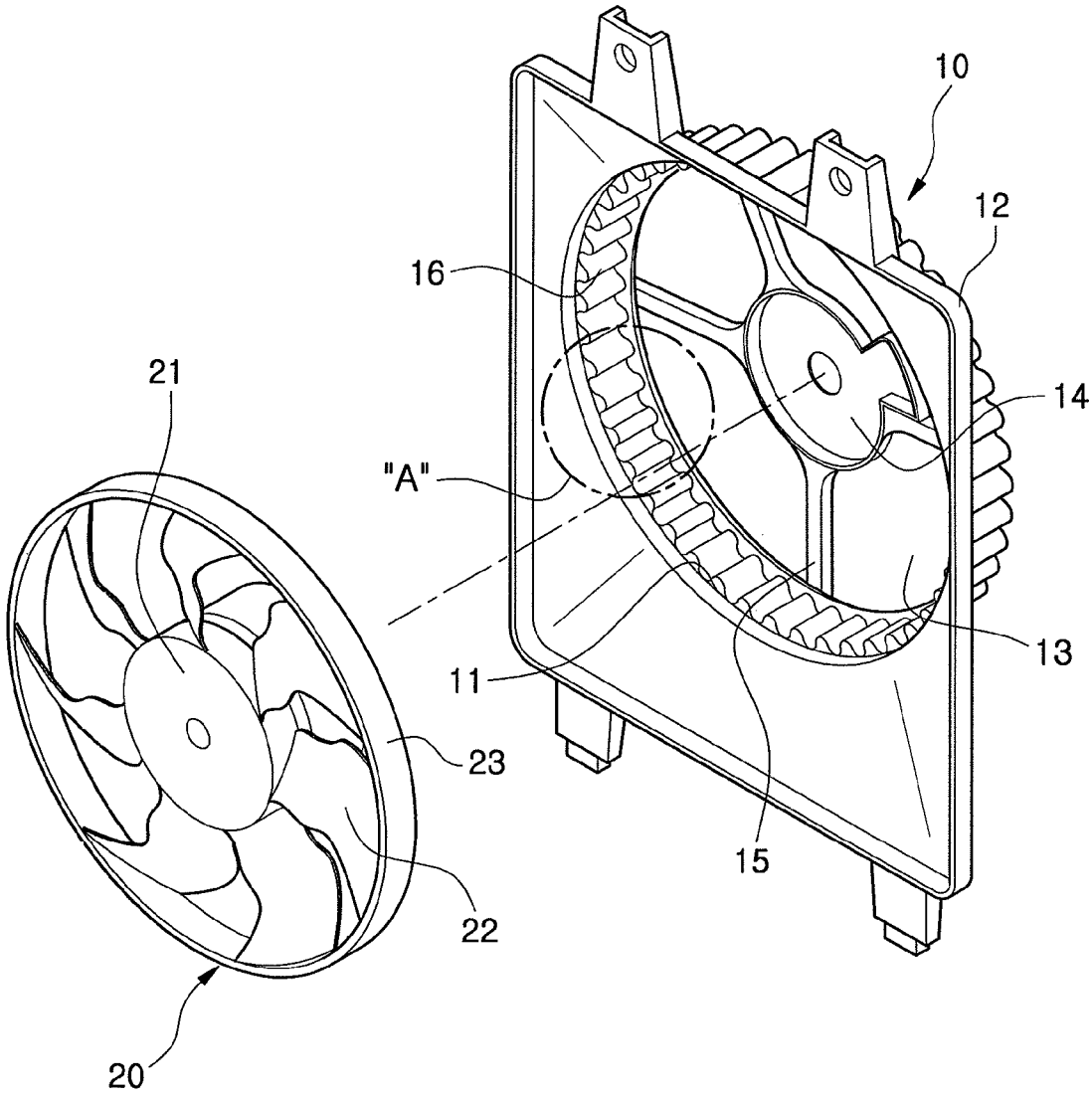
FIG. 6 is an exploded perspective view of a fan and a shroud according to the preferred embodiment of the present invention.
Figure 7:
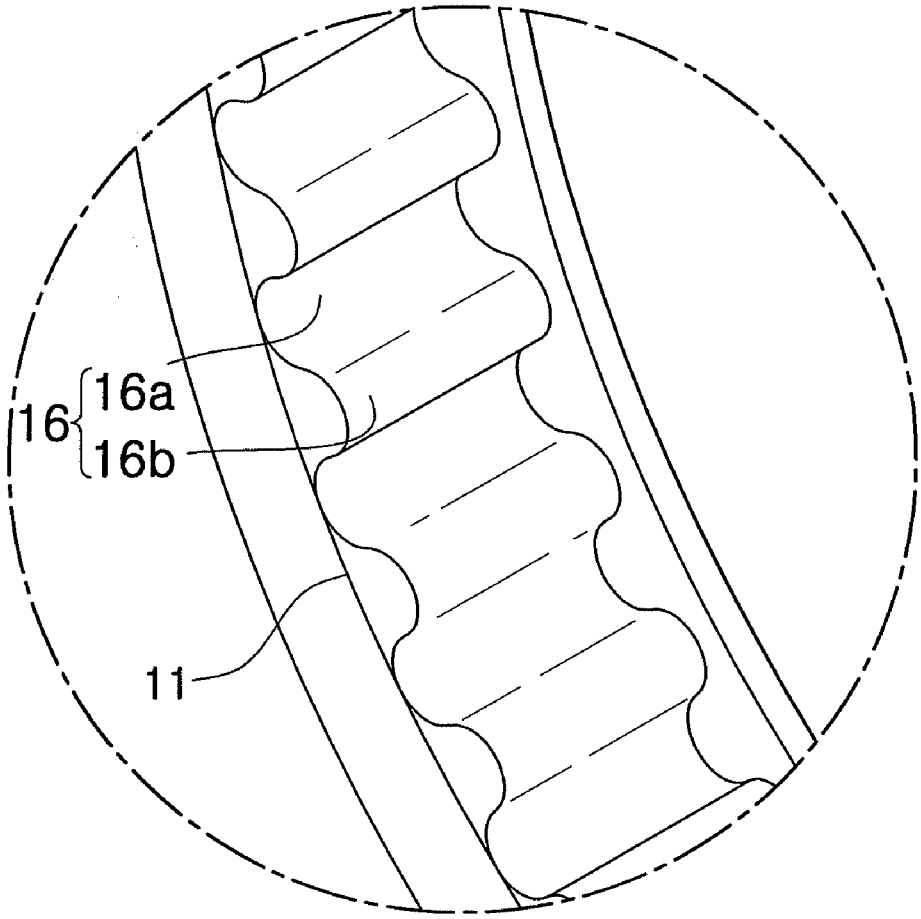
FIG. 7 is a detailed view of part "A" of FIG. 6.
Figure 8:
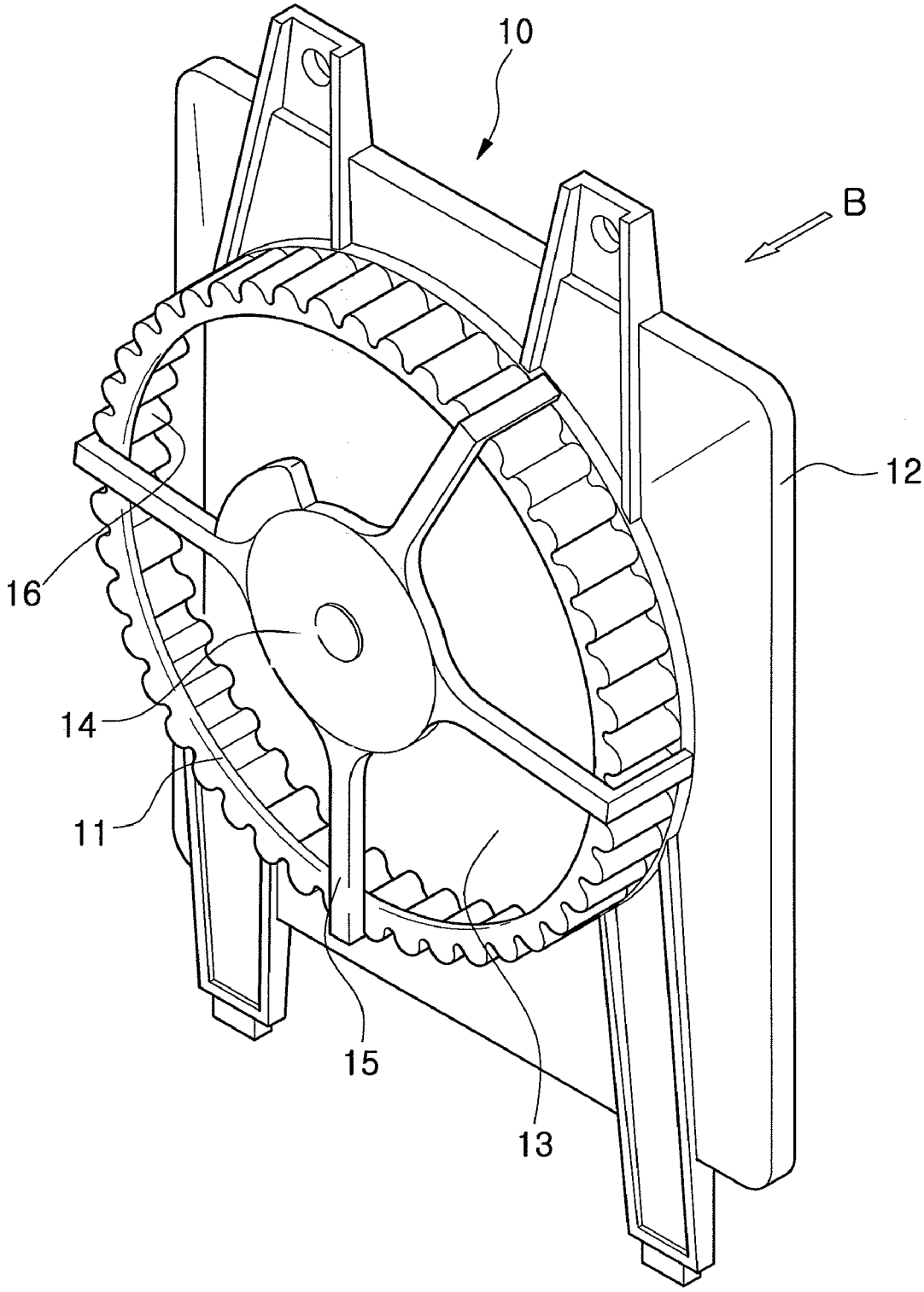
FIG. 8 is a perspective view of the shroud according to the preferred embodiment of the present invention.
Figure 9:
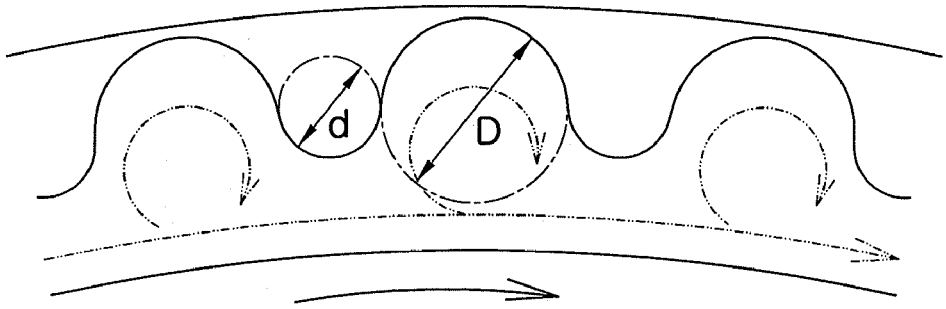
FIG. 9 is a view indicating the dimensions and arrangement of round corrugation formed on the shroud, as seen from part "B" of FIG. 8.

FIG. 5 is a front view of a fan and shroud assembly according to the preferred embodiment of the present invention, FIG. 6 is an exploded perspective view of a fan and a shroud according to the preferred embodiment of present invention, FIG. 7 is a detailed view of part "A" of FIG. 6, FIG. 8 is a perspective view of the shroud according to the preferred embodiment of the present invention, and FIG. 9 is a view indicating dimensions and arrangement of a round corrugation formed on the shroud, as seen from part "B" of FIG. 8.

The fan and shroud assembly according to the preferred embodiment of the present invention comprises a fan 20 having a hub 21 rotatable on a shaft and a plurality of blades 22 extending outward from the hub 21, and a shroud 10 surrounding the fan 20 for controlling the air blast resulting from rotation of the fan 20. The shroud 10 comprises a guide ring part 11 spaced apart at a predetermined interval from the periphery of the fan. The periphery of the fan, defined by band 23, connects the ends of the blades 22 together. Shroud 10 also includes swirl preventing means formed on the guide ring part 11; the swirl preventing means prevents swirling air from flowing along the peripheral band connecting the ends of the blades 22.

The shroud 10 comprises a housing 12 having a blast inlet 13 in which the fan 20 is inserted, a motor supporting part 14 located at the center of the blast inlet 13 for supporting a motor (not shown) for driving the fan 20, and ribs 15 for connecting the motor supporting part 14 and the housing 12 with each other. The swirl preventing means is round corrugations 16 formed on the guide ring part 11.

Because the fan 20 comprises a band 23 for connecting the ends of the blades 22, the round corrugations 16 are spaced a predetermined distance from the band 23.

The round corrugations 16 have round furrows 16*a* having a predetermined radius of curvature (D/2) at portions which extend outwardly from the center of the shroud and round projections 16*b* having a predetermined radius of curvature (d/2) at the portions which extend toward the center of the shroud, where D>d and the round furrows 16*a* and the round projections 16*b* are repeatedly arranged.

The fan and shroud assembly having the above configuration somewhat increases power consumption but can reduce noise since it minimizes generation of air swirl.

When the fan 20 is rotated, swirling air flows in the rotational direction of the fan 20 in a space between band 23 and the inner periphery of guide ring part 11. Such swirling air has a circular flow with a small diameter as shown in FIG. 9 due to a pressure difference between the round furrows 16*a* and the round projections 16*b*. The circular flow serves as a shielding membrane in the space between the band 23 and the inner periphery of the guide ring part 11, so as to prevent swirling airflow and backflow. Therefore, the present invention can reduce noise.

Moreover, the circular flow can progress smoothly progressed with little resistance since the furrows 16*a* are round.

The main factors for determining performance in relation with the noise reduction effect are a diameter D of the round furrow 16*a* and the number N of the round furrows 16*a* of the corrugation 16. At this time, it is preferable that the diameter of the round furrow 16*a* is 5.0 mm~30.0, and more preferably, within a range of 5.0~15.0 mm. It is preferable that the number of the round furrows 16*a* formed along the peripheral direction of the guide ring part 11 is 20~60.

Hereinafter, test results of the prior art fan and shroud assembly having the swirl preventing saw teeth and the fan and shroud assembly of the present invention will be described.

The test was carried out by the steps of mounting the fan and shroud assembly on a heat exchanger, applying a voltage of 12V, preheating the heat exchanger for 15 minutes, and measuring rotational frequency, blast capacity and noise at 12V, 13.5V and the same blast capacity. The test results are shown in the Table 1 and FIG. 10.

Figure 11:
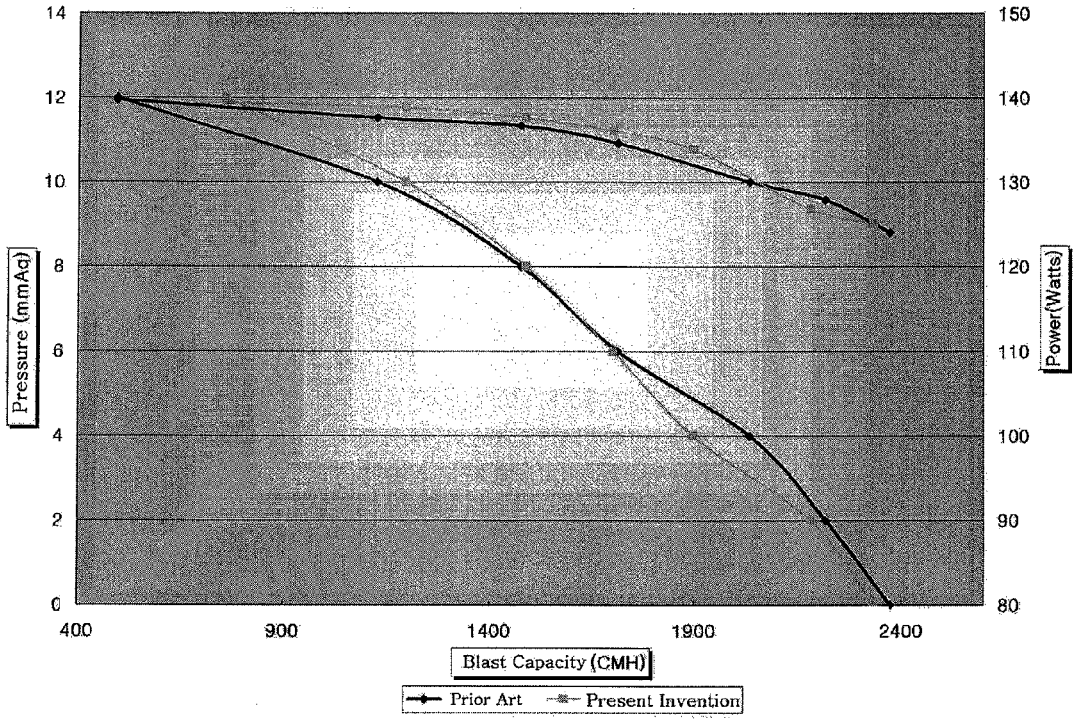
FIG. 11 is a P-Q graph comparing the shroud between the prior art fan and shroud assembly and the fan and shroud assembly of FIGS. 5-9 with changes of pressure.

Furthermore, blast capacity was measured while pressure is lowered by 2 mmAq (where 1 atmosphere=10.332 mmAq=760 mmHg) within a range of constant pressure of 0.0~12.0 mmAq in a single product state. The measured results are shown in FIG. 11.

TABLE 1

| Terms | Sample | Voltage (volt) | Current (A) | Consumption power (Watt) | Difference (%) | Rpm | Blast Capacity (CMH) | Difference (%) | Noise dB(A) | Difference dB(A) | 1st peak dB(A) | Difference dB(A) |
|---|---|---|---|---|---|---|---|---|---|---|---|---|
| 12 V | Prior art | 12.0 | 11.0 | 132.1 | — | 1732 | 1446 | — | 63.2 | — | 53.8 | — |
| | Fan of FIGS. 5-9 | 12.0 | 11.0 | 132.1 | 0 | 1732 | 1446 | −1.4 | 61.9 | −1.3 | 50.0 | −3.8 |
| 13.5 V | Prior art | 13.5 | 12.8 | 172.7 | — | 1876 | 1592 | — | 64.9 | — | 55.1 | — |
| | Present invention | 13.5 | 12.8 | 172.7 | 0 | 1874 | 1570 | −1.4 | 63.7 | −1.2 | 52.5 | −2.6 |
| Same blast capacity | Prior art | 12.0 | 11.0 | 132.1 | — | 1732 | 1446 | — | 63.2 | — | 53.8 | — |
| | Fan of FIGS. 5-9 | 11.2 | 12.2 | 136.6 | 3.4 | 1740 | 1446 | — | 62.1 | −1.1 | 50.1 | −3.7 |

Figure 10:
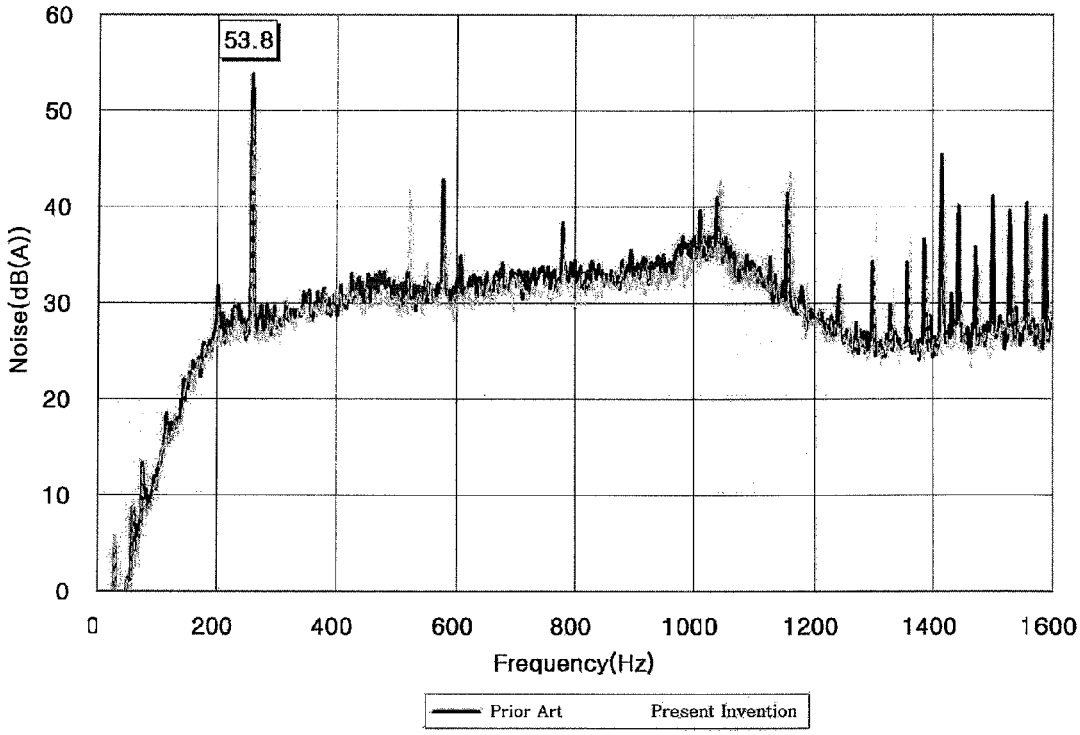
FIG. 10 is a graph comparing noise spectra of the prior art fan and shroud assembly and the fan and shroud assembly of FIGS. 5-8 in the same blast capacity.

In the test results shown in the Table 1 and FIG. 10, at the same voltage (12V, and 13.5V), compared with the prior art, the fan and shroud assembly according to FIGS. 5-9 had an overall noise reduction, and reduced first peak value of the noise spectrum. However, the blast capacity was reduced a little and the power consumption was equal to that of the prior art fan and shroud assembly.

Meanwhile, at the same blast capacity, compared with the prior art, the fan and shroud assembly according to FIGS. 5-9 was greater in power consumption than the prior art, but the overall noise was reduced about 1.1 dB, and peak noise was reduced about 3.7 dB.

Moreover, referring to FIG. 11 showing P-Q line graph, the shroud of FIGS. 5-9 was equal in the entire constant pressure area (P) and the blast capacity (Q) with the saw teeth type shroud of the prior art.

As described above, the fan and shroud assembly according to the present invention can minimize generation of swirling airflow and backflow and provide improved noise-reduction effect by the round corrugation formed along the inner periphery of the blast inlet of the shroud.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A fan and shroud assembly comprising:

a fan having a hub rotatable on a shaft and a plurality of blades extending outward from the hub, the blades having ends remote from the hub connected to each other; and a shroud surrounding the fan for controlling air blast resulting from rotation of the fan, wherein the shroud comprises: a guide ring part spaced at a predetermined distance from the periphery of the fan; and swirl preventing means of a round-corrugation type formed on the guide ring part for preventing swirling airflow along the periphery of the fan, wherein the swirl preventing means comprises round furrows, each having a predetermined radius of curvature at a portion which is depressed in a radial direction and round projections, each having a predetermined radius of curvature at a portion which projects toward a central direction of the shroud, the round furrows and the round projections being repeatedly arranged, wherein the round furrows and the round projections are inter-connected with each other continuously such that when inter-connecting the circular arcs of the round furrows with the circular arcs of the round projections along a circumferential direction, there is not a straight line section, and the round furrows each have a diameter D different from a diameter d of each round projection.

2. The fan and shroud assembly according to claim 1, wherein the diameter of each of the round furrows is in the range of 5.0 mm~30.0 mm.

3. The fan and shroud assembly according to claim 1, wherein the swirl preventing means is formed along the periphery of the guide ring part, and the number of the round furrows is in the range of 20~60.

4. The fan and shroud assembly according to claim 1, wherein the fan further comprises a band connecting the ends of the blades.

* * * * *